United States Patent [19]

Thornbery et al.

[11] 4,415,784

[45] Nov. 15, 1983

[54] TIMER WITH DELAYED START CAPABILITY

[75] Inventors: James M. Thornbery, Vernon Hills; George Obermann, Niles; Edward J. Mateja, Hillside, all of Ill.

[73] Assignee: The Singer Company, Stamford, Conn.

[21] Appl. No.: 301,142

[22] Filed: Sep. 11, 1981

[51] Int. Cl.[3] ..... H01H 43/00

[52] U.S. Cl. ..... 200/35 R; 200/38 R

[58] Field of Search ..... 200/35 R, 38 R, 38 A, 200/38 FA, 38 B, 38 BA, 38 C, 38 CA, 38 D

[56] References Cited

U.S. PATENT DOCUMENTS

| | | | |
|---|---|---|---|
| 2,920,153 | 1/1960 | Horstmann | 200/38 A |
| 3,372,597 | 3/1968 | Dotto | 200/38 A X |
| 3,700,837 | 10/1972 | Schulze-Berge | 200/38 A X |

*Primary Examiner*—J. R. Scott

*Attorney, Agent, or Firm*—David L. Davis; Robert E. Smith; Edward L. Bell

[57] ABSTRACT

The timing (program) cam is driven at timing speed through a gear train which includes a clutch. When a delayed start is desired the timing cam must be positioned at the start of a cycle so a lever sensing the cam position will move a tiltable jackshaft to an active position in which the worm gear on the shaft can be engaged by a manually set ratchet segment while a cam moving with the segment de-clutches the timing speed drive. The worm gear rotation drives the ratchet back to zero at which time the clutch is engaged and normal timing begins. The number of ratchet teeth engaged with the worm gear determines the length of the time delay.

12 Claims, 5 Drawing Figures

TIMER WITH DELAYED START CAPABILITY

TECHNICAL FIELD OF THE INVENTION

This invention relates to program timers with provision for starting the program after a selected time interval.

BACKGROUND OF THE INVENTION

In the past it has been customary to use a second motor to time the delayed start of a program timer. In effect the prior art used a simple motor driven timer to time the delayed start of a program timer driven by another motor. The first timer controlled the electric power supply to the program timer motor. Obviously it would be desirable to use only one motor. But how this can be done is not obvious.

SUMMARY OF THE INVENTION

The object of this invention is to provide a program timer with delayed start capability without use of a second motor. Put another way, the object of this invention is to provide a reduced cost delayed start timer. Another object is to provide a program timer with mechanism for selectively delaying the start of the timer program at less cost than the prior art use of a second timer to obtain the delayed start.

These objects have been attained through provision of selectively operable mechanism only at the start-of-program position of the timer to disengage the drive to the timing cam for a time delay period at the end of which the drive to the program cam is engaged, the time delay mechanism being driven by the same motor as the timing cam.

DETAILED DESCRIPTION OF THE DRAWINGS

Figure 1:
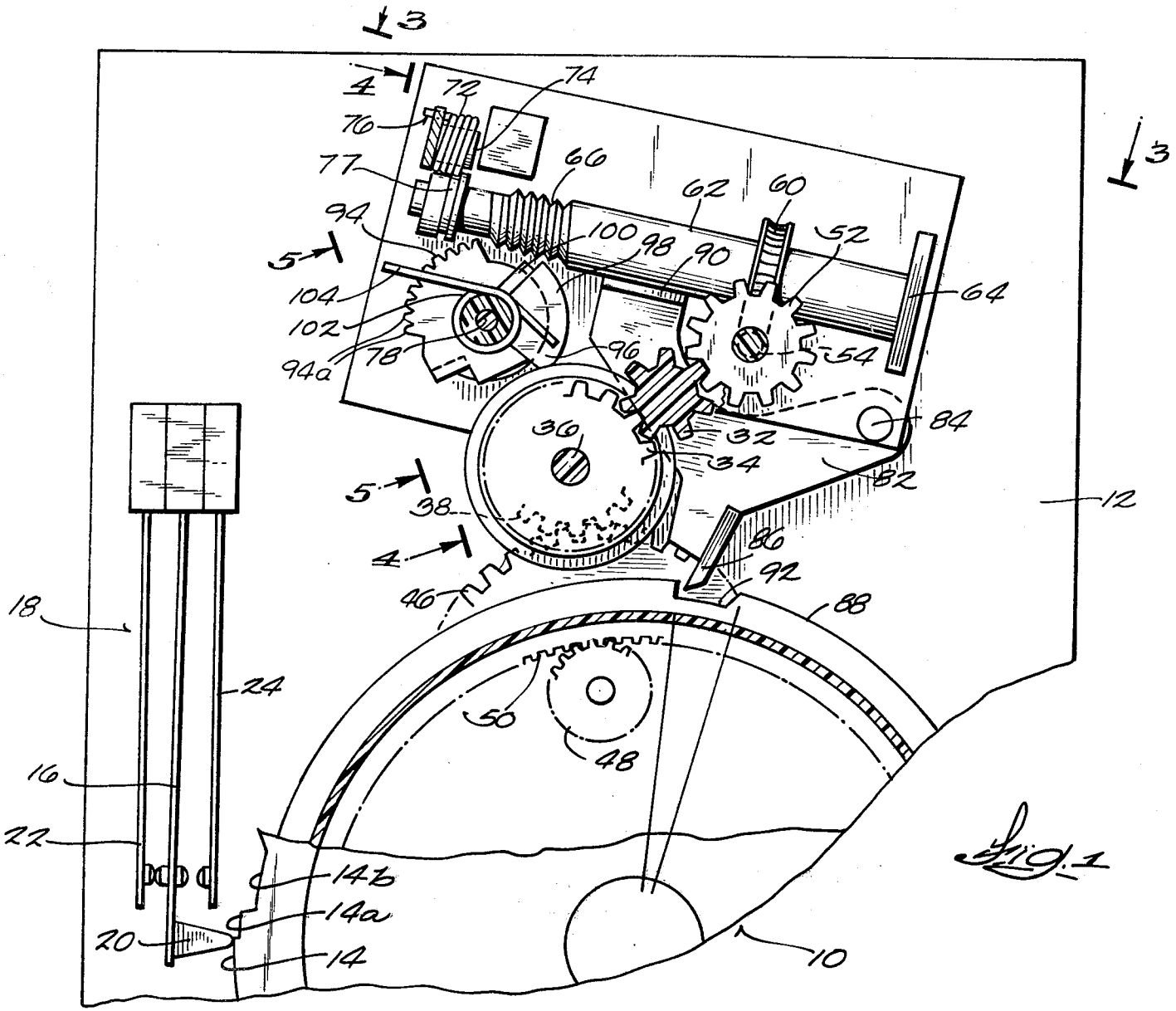
FIG. 1 is a fragmentary section through the timer showing the principal elements of the main drive and the time delay drive.
Figure 2:
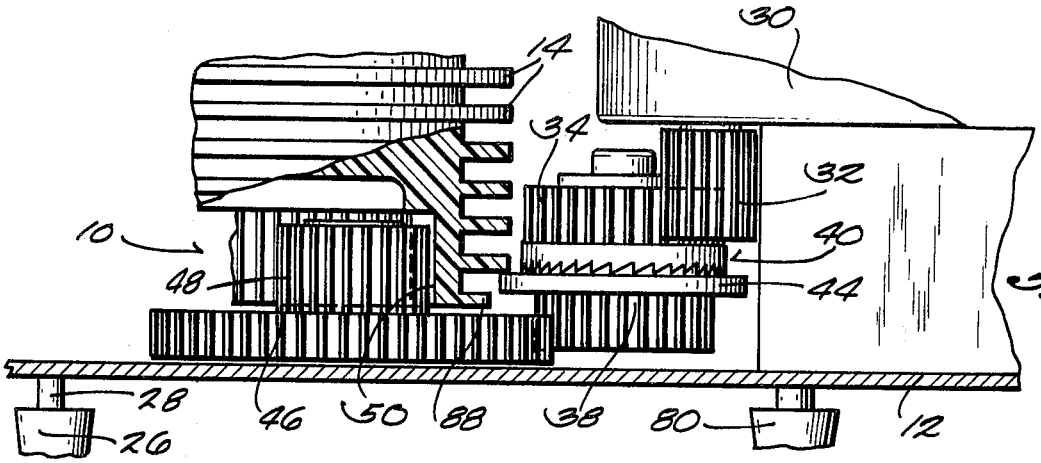
FIG. 2 is a fragmentary meandering section through FIG. 1 showing the relationship of and drive from the motor pinion, intermediate gears, and the timing cam.

Program timers are well known. Accordingly, in the interest of clarity the drawings and this description will deal only with the structure necessary to understanding this invention and some details not relevant to the present invention are omitted. The timing cam 10 is rotatably journaled between front plate 12 and a rear plate not shown. The timing cam is provided with a multiplicity of cams 14 of various configurations to properly sequence the switches as the timing cam is rotated. As an example, in FIG. 1 the center blade 16 of switch 18 has a follower 20 which follows the contour of cam 14. As shown the cam has raised blade 16 into contact with the blade 22. When the timing cam rotates so the follower drops to surface 14*a* the center blade 16 will move away from blade 22 and when the follower rests on surface 14*b* blade 16 will close on blade 24. The timing cam can be rotated (forward only) by knob 26 mounted on shaft 28 which is connected to the timing cam so as to permit axial shaft movement to operate the usual line switch which supplies electric power to the timer motor 30 in all positions of the timer except its "off" position at the end of a program.

The timing cam is advanced by the motor through a gear drive including the motor pinion 32 driving gear 34 molded with an integral shaft 36 journaled in the timer frame. A pinion 38 is mounted on shaft 36 and has axially facing ratchet teeth engaging similar teeth on gear 34 to form a one-way clutch/drive 40 between the gear 34 and pinion 38 when the clutch is engaged. The pinion 38 is biased to engage the clutch key spring 42. The pinion 38 is provided with a projecting rim 44 which can be moved axially as described hereinafter. The clutch is engaged in timing operation so pinion 38 rotates with gear 34 and drives gear 46 which, together with the integral pinion 48, is mounted on a shaft fixed in plate 12. Pinion 48 drives the internal gear 50 on the inside end of the timing cam. This type of drive from the motor to the timing cam is fairly common except for the provision of clutch 40 between gear 34 and pinion 38 which allows the drive to the timing cam to be interrupted while the motor pinion 32 continues to rotate.

Figure 3:
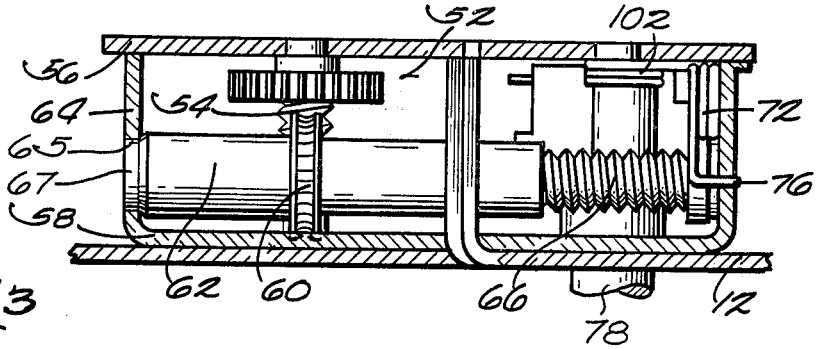
FIG. 3 is a view taken from line 3—3 in FIG. 1.
Figure 4:
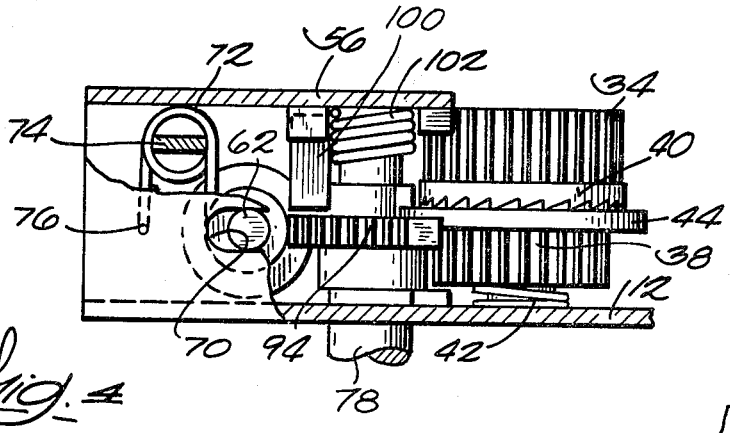
FIG. 4 is a view from meandering line 4—4 in FIG. 1.
Figure 5:
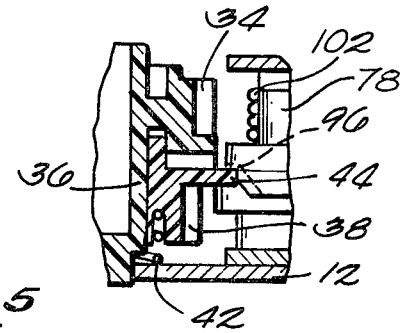
FIG. 5 is a partial section of FIG. 1 on line 5—5.

Motor pinion 32 constantly drives gear 52 which is molded integral with worm gear 54 and is journaled between plates 56, 58 which support the time delay mechanism. Worm 54 drives gear 60 molded integral with jackshaft 62 having its left end (FIG. 3) tiltably and rotatably journaled in plate 64 and its right end provided with a worm gear 66 with the right end of the shaft 62 slidably mounted in a slot 70 for swinging movement of the shaft about its left end. The tiltable journaling of the left end of the shaft 62 is accomplished by providing an opening 65 in the plate 64 which is larger than the extension 67 of the shaft 62. A spring 72 coiled around post 74 with one end anchored on the frame at 76 and its other end bearing in a groove 77 of shaft 62 biases the shaft towards shaft 78 journaled in plates 56, 58 and projecting through plates 58 and 12 to support knob 80.

During program timing operation movement of shaft 62 under the spring bias is limited by a Y-shaped lever 82 pivoted on pin 84 carried by plate 58. The "leg" of lever 82 has a follower tip 86 which rides on the perimeter of cam 88 on the end of the timing cam while the left "arm" of lever 82 is provided with a tab 90 which projects under shaft 62. Spring 72 acting on shaft 62 urges the shaft against tab 90 and, therefore, biases the lever 82 so follower 86 is biased against cam 88. When the follower is on the maximum diameter part of cam 88 the lever holds shaft 62 in a position where it does nothing other than rotate. When the follower drops into a notch 92 the lever allows the shaft 62 to move down (FIG. 1) to a position in which the ratchet segment 94 on shaft 78 can engage worm 66. Notches 92 are provided only at positions corresponding to the start of a program. As will be explained, engagement of one or more ratchet teeth 94*a* with worm 66 determines the time delay and since the teeth can only be engaged with worm 66 when the timing cam is at the cycle start position the time delay can operate only at the start of a cycle.

Shaft 78 is provided with an axially facing cam 96 which is on one end of a segment 98 which is urged against stop 100 by the bias of tension spring 102 coiled around shaft 78 with one end 104 bearing against the frame and the other end bearing against the segment 98 to bias shaft 78 counterclockwise (FIG. 1). The axially facing cam 96 runs over the clutch rim 44 and disengages clutch 40 when shaft 78 is turned to engage one or more ratchet teeth 94*a* with worm 66. Therefore, the drive to the timing cam is interrupted as long as the ratchet 94 is engaged with worm gear 66. Obviously in the start-of-cycle position the power circuit to the motor must be completed and remain so until the end of the cycle. The gear ratios from the motor pinion to worm 66 are selected so it takes one hour to drive one ratchet tooth 94*a* out of engagement with worm 66. There are 10 ratchet teeth 94*a* so the user can select a time delay from 1 to 10 hours. As the ratchet teeth 94*a* are turned into engagement with the worm the worm is pushed away against the bias of spring 72. This gives a definite detent feel to the setting action and the user can select the time delay by counting the detents or by reference to an indicator dial. When the worm releases the last tooth, the spring 102 will return shaft 78 to its inactive or zero position (segment 98 against stop 100) and the clutch 40 will re-engage to start the drive to the timing cam. The worm/ratchet mechanism functions as a time delay timer driven by the motor and determining how long the clutch will be disengaged.

If shaft 78 is turned to select a delay during a program the cam 96 would disengage the clutch but the ratchet 94 cannot be engaged with worm 66 and the shaft 78 would return to zero when released (and the clutch would re-engage). If knob 26 is turned to advance the timer during a time delay the lever 82 will lift the shaft 62 to take worm 66 away from the ratchet 94—the ratchet 94 will then return to zero cancelling the time delay. The time delay can be set and maintained only when and as along as the timing cam is at the start of a program. At the end of a time delay the program timing starts and cam 88 is turned to lift lever 82 to the position disabling the time delay setting possibilities.

While this invention has been described with respect to a continuous drive timer it could be used with a step-type drive by placing the clutch ahead of the stepping mechanism. It will be appreciated the important aspect of this invention is the provision of the clutch in the drive to the timing cam and means for disengaging and timing the duration of the disengagement by a timing arrangement driven by the same motor as the timing cam.

We claim:

1. In a timer having a timing cam operative to operate switches in a sequence and driven from a starting position to the end of the sequence by a motor connected to the timing cam through a drive mechanism including gearing, the improvement being provision for delaying the start of the sequence for a period of time, the improvement comprising, clutch means in said gearing, disengaging means biased to an inoperative position and movable to an operative position to disengage the clutch means, time delay timing means driven by said motor and operative to hold the disengaging means in its operative position for a selected period of time, and means enabling operation of the time delay timing means at said starting position of the timing cam and preventing operation of the time delay timing means in all other positions of the timing cam.

2. A timer according to claim 1 in which the time delay timing means includes, restraining means biased to an inactive position and movable to manually selected active positions, means driven by said motor and engaged by said restraining means in any of said active positions and operative to return said restraining means to said inactive position at a speed which is a function of the speed of said motor.

3. A timer according to claim 2 in which the last named means is gearing ending in a constantly rotating gear, and said restraining means comprises a toothed member engageable with the constantly rotating gear.

4. A timer according to claim 3 in which the constantly rotating gear is movable between a first position in which it cannot be engaged by said toothed member and a second position in which it can be engaged by said toothed member, said means enabling operation being responsive to the position of the timing cam and operative to hold said constantly rotating gear in said first position in all positions of the timing cam except the starting position of the timing cam at which position said means enabling operation moves the constantly rotating gear to said second position.

5. A timer according to claim 4 in which the disengaging means and the toothed member are mounted on a common manually operable shaft.

6. A timer according to claim 5 in which the constantly rotating gear is a worm gear and the toothed member is a ratchet the teeth of which lie on a radius about the center of the manually operable shaft.

7. A program timer of the type having a motor drivingly connected to a timing cam provided with cams for controlling switches in a predetermined sequence from the start to end of a program, the improvement being means for delaying the start of a program comprising, manually operated selection means for selecting a desired time delay period, means responsive to selection of a time delay to disengage the drive from the motor to the timing cam, means driven by said motor to re-engage the drive to the timing cam at the end of the selected time delay, and means preventing operation of said selection means except when the timing cam is at the start of a program.

8. A program timer according to claim 7 in which the means to disengage the drive comprises a clutch in the drive from the motor to the timing cam and means actuating the clutch in response to operation of the selection means.

9. A program timer according to claim 8 in which said selection means is movable from a zero time delay position to various time delay positions, said re-engaging means including, a rotating gear driven by the motor, a gear-like segment engageable with the gear and biased to a zero time delay position in which it is out of engagement with the gear, movement of the selection means to any time delay position being operative to engage the gear-like segment with the gear and rotation of the gear being operative to return the segment to its zero delay position at a speed related to motor speed.

10. A program timer according to claim 9 in which the means actuating the clutch and the gear-like segment are actuated by the selection means.

11. A program timer according to claim 10 in which the preventing means is responsive to the position of the timing cam and moves said gear between a position in which it cannot be engaged by said segment and a position in which it can be engaged by the segment.

12. A program timer of the type having a motor driving a timing cam to actuate switches according to a desired sequence from the start to end of a program, the improvement being provision for delaying the start of a program for a selected period, comprising, a clutch in the drive between the motor and the timing cam, gear means driven by the motor from a point between the motor and the clutch input, said gear means including a worm gear, a ratchet segment mounted on a rotatable shaft for movement from a zero delay position in which it is not engaged with said worm gear to various positions in which one or more ratchet teeth are engaged with the worm gear, manual means for rotating the shaft, means responsive to rotation of the shaft from the zero delay position to operate said clutch to interrupt the drive to the timing cam and to re-engage the clutch on return to the zero delay position, said worm gear being operative to drive the segment back towards the zero delay position, a spring biasing the segment to the zero delay position, said worm gear being movable between an active position in which it can engage said segment and an inactive position in which it cannot engage the segment, means responsive to the position of the timing cam to move said worm gear between said active and inactive positions and operative to position the worm gear in its active position only when the timing cam is in its start position, said segment returning to the zero delay position under influence of the spring bias if the timing cam is moved out of its start position while the segment is engaged with the worm gear.

* * * * *